United States Patent [19]

Dudley

[11] 4,382,858

[45] May 10, 1983

[54] PIVOTED AND BALANCED GATE FOR A MATERIAL SEPARATOR

[75] Inventor: Robert H. Dudley, Portage, Mich.

[73] Assignee: Reclamet, Inc., Kalamazoo, Mich.

[21] Appl. No.: 347,768

[22] Filed: Feb. 11, 1982

Related U.S. Application Data

[63] Continuation of Ser. No. 191,799, Sep. 29, 1980, abandoned.

[51] Int. Cl.[3] ..... B07B 4/02

[52] U.S. Cl. ..... 209/136; 209/615; 209/631; 209/149

[58] Field of Search ..... 241/81; 209/34–37, 209/26–29, 136–139 R, 157–159, 247, 250, 359, 149, 615, 638, 631

[56] References Cited

U.S. PATENT DOCUMENTS

| | | | |
|---|---|---|---|
| 1,272,311 | 7/1918 | Plaisted | 209/139 R |
| 2,203,821 | 6/1940 | Hinchman | 209/139 R X |
| 2,344,591 | 3/1944 | Bried | 241/81 |
| 4,137,176 | 1/1979 | Dudley et al. | 210/375 |

FOREIGN PATENT DOCUMENTS

| | | | |
|---|---|---|---|
| 506578 | 10/1954 | Canada | 209/137 |
| 2636989 | 2/1978 | Fed. Rep. of Germany | 241/81 |
| 470445 | 8/1937 | United Kingdom | 209/139 R |

*Primary Examiner*—Ralph J. Hill

*Attorney, Agent, or Firm*—Flynn, Thiel, Boutell & Tanis

[57] ABSTRACT

In a device for separating a liquid, as a cutting oil, from a mixture of metal chips and larger pieces of metal, such as bar ends and scrap, there is provided structure for preliminarily separating larger pieces of metal from the entire mass prior to the separation of the oil from the chips by a centrifuge. The structure includes a chute for feeding the mixture to be separated into the centrifuge, and a strong stream of air is caused to flow through the chute into the centrifuge. An opening is provided in the bottom of the chute intermediate its ends such that bar ends and other large pieces of metal which may be included in said mixture will drop through the opening, while air being drawn by the centrifuge into the chute through the opening will entrain the metal chips to prevent their dropping out of the opening and carry them onward through the chute into the centrifuge. A movable gate responsive to the presence in the chute of pieces of metal too large to otherwise drop through the opening is provided for temporarily increasing the size of the opening sufficiently to permit such pieces to drop through the opening.

10 Claims, 4 Drawing Figures

PIVOTED AND BALANCED GATE FOR A MATERIAL SEPARATOR

This application is a continuation, of application Ser. No. 191,799, filed Sept. 29, 1980, now abandoned.

FIELD OF THE INVENTION

The invention relates to feeding means for a separator and particularly to means for separating the undesirable components of the solid scrap, such as bar ends and piece parts, from a mixture of such larger pieces, chips and a liquid, as a cutting fluid, prior to the feeding of the remaining mixture of chips and fluid to separator means for separating the fluid from the chips.

BACKGROUND OF THE INVENTION

Separator means, particularly a centrifugal separator, also known as a wringer or a centrifuge, are already known for separating mixtures of metal chips from oil, such mixtures being produced for example, by lathes and by other machine tool operations. An example of such a separator is disclosed in U.S. Pat. No. 4,137,176 entitled "Chip Discharge for Continuous Chip Wringer", assigned to the same assignee as is the present disclosure. Another generally similar separator is shown in U.S. Pat. No. 3,850,814. Such separator provides a rotary separator having upwardly diverging sides with a perforate zone intermediate the upper and lower edges thereof. A mixture of chips and oil fed centrally into said rotor moves upwardly along said walls in response to centrifugal force, the oil moving outwardly to suitable receiving means through the perforated zone and the chips doing likewise to other receiving means over the upper edge of said rotor. To assist in conveying the chips to the receiving means for same, said rotor is preferably supplied with impeller means for drawing a strong stream of air into such centrifuge and driving it outwardly with said chips as at least a partial carrier for same.

Such equipment operates very well and has received good commercial acceptance. However, it often happens that bar ends, finished parts or other large pieces of metal are included in the mixture of chips and oil as same is introduced into the separator. If certain ones of the pieces of metal are very large, as they often are, same will seriously damage the rotor of the separator and will often do so very quickly. This has posed a dilemma of either (1) inspecting the mixture prior to introducing same into the separator and removing therefrom such large pieces of metal, which procedure is economically impractical, or (2) submitting to frequent shutdowns and frequent maintenance of the separator as a result of such large pieces of metal entering thereinto. This dilemma has inhibited the commercial acceptance of the separator as above described from what might otherwise be possible.

Attempts to solve the dilemma have been made, such as the provision of an air classification system upstream of the separator to remove the bar ends and other large pieces of metal, but such solutions have not been entirely satisfactory. For example, an air classification system utilized in conjunction with a crusher is shown in a publication of National Conveyors Company, Inc., Bulletin C-1-67, entitled "National ChipVeyors for Metal Chip Processing and Oil Reclamation". This system, however, is very complicated and expensive and therefore has had very limited use in combination with centrifugal separators. The reason is that the potential for severe damage to a separator by large metal pieces is much less than that for a crusher, and therefore the complex and expensive air classification system is harder to justify for a separator than for a crusher.

One workable solution to the dilemma has been developed, is the subject of U.S. Pat. No. 4,310,417, issued Jan. 12, 1982 and is assigned to the same assignee as is the present disclosure. That application discloses the use of an inclined conduit or chute to feed a separator apparatus, which conduit has an opening in the bottom thereof through which a strong current of air is drawn into the conduit and then into the separator, the stream of air being sufficient to entrain chips and liquid in the conduit and carry them to the separator, but being insufficient to entrain large pieces of metal, such that the latter strike a barrier located at the downstream side of the opening and then drop through the opening due to gravity. Despite the advantages of this approach over prior approaches, a problem is still presented when pieces of metal are introduced into the system that are too large to drop through the opening, since those pieces either pass into the separator and cause damage or they become lodged in and obstruct the opening.

Accordingly, the objects of the invention include:

1. To provide inexpensive classification means for removing large pieces of metal from a mixture of such pieces of metal, metal chips and liquid prior to the introduction of the metal chips and liquid into means for separating the liquid and metal chips from each other.

2. To provide inexpensive classification means, as aforesaid, which is compatible with a system in which a large quantity of air is caused to enter into the separating means and expelled therefrom as at least a partial carrier for said chips.

3. To provide inexpensive classification means, as aforesaid, which will be relatively simple and can be applied to equipment of an existing design by relatively minor modification thereof.

4. To provide inexpensive classification means, as aforesaid, which will have a high degree of reliability and will maintain its reliability over a long period of time with a minimum of maintenance.

5. To provide inexpensive classification means, as aforesaid, which will not interfere with the proper operation of the means separating the liquid and chips from each other.

SUMMARY OF THE INVENTION

In general, the objects and purposes of the invention are met by providing a chute for feeding the mixture to be separated into separating means, the bottom of said chute having an opening for permitting large pieces of metal to drop therethrough. The air drawn by the separator into same and expelled therefrom as at least a partial carrier for the chips is at least in part drawn through the opening and thereby prevents the chips and liquid from dropping therethrough. A movable gate responsive to the presence in the chute of pieces of metal too large to otherwise drop through the opening is provided for temporarily increasing the size of the opening sufficiently to permit the pieces to drop through the opening.

DETAILED DESCRIPTION OF THE DRAWINGS

Figure 1:
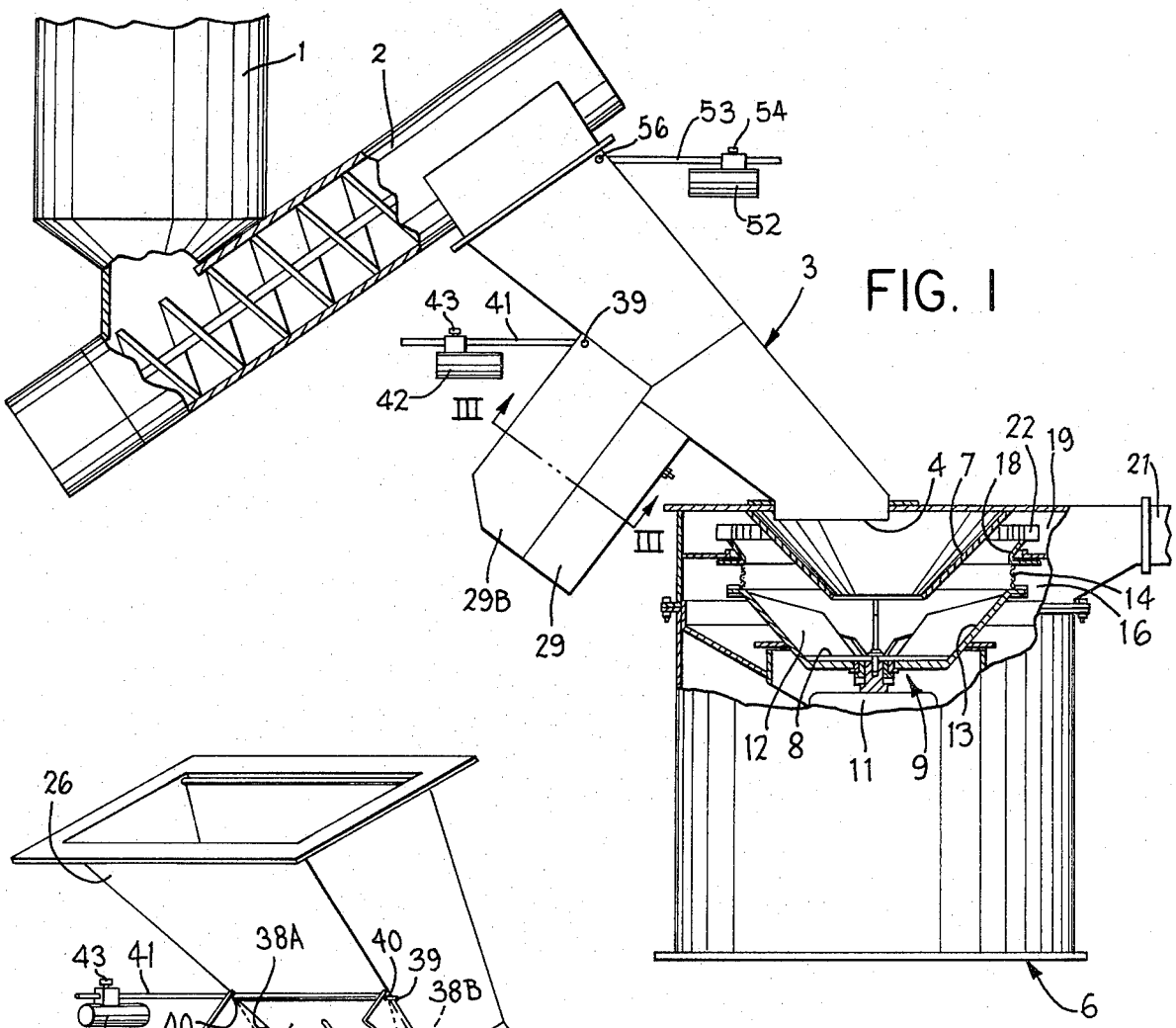
FIG. 1 is a side elevational, partially broken view of a separator and a feeding device therefor embodying the present invention.

Certain terminology will be used in the following description for convenience in reference only and will not be limiting. The words "up" and "down" will designate directions in the drawings to which reference is made. The words "upstream" and "downstream" will refer to the directions of material flow relative to an air classifying opening 28, the upstream part of the material flow being to the left of the opening 28 in FIG. 2. The words "in" and "out" will refer to directions toward and away from, respectively, the geometric center of the device and designated parts thereof. Such terminology will include derivatives and words of similar import.

Referring now to the drawings, a brief description of one form of a conventional separator apparatus will first be set forth hereinafter in order that the function of the novel apparatus associated therewith will be better understood. This description, however, will be substantially abbreviated, inasmuch as full details of the separator apparatus may be had by referring to U.S. Pat. No. 4,137,176 reference to which is to be incorporated herein.

Referring to FIG. 1, a mixture of chips, including whatever large pieces of metal may be found therein, and a liquid, normally a cutting oil, is received by a hopper 1 and discharged therefrom into a conveyor 2 which carries the mixture to the upper end of and discharges same into a tubular feeding chute 3 of rectangular cross section. The chute then discharges the mixture through the opening 4 of the separator 6. From the opening 4 the mixture drops through a guiding cone 7 to the bottom 8 of an inverted frustoconical drum or rotor 9 which is driven in any conventional manner, such as by a motor 11. The mixture is caused to rotate rapidly with the rotor 9, assisted in the following of the rotor by the radially positioned, accurately spaced, blades 12, and responds to centrifugal force in a known manner to move upwardly along the interior of the conical sidewall 13 of the rotor 9. As the material reaches the screen 14, the oil is separated from the chips and gathered in the annular chamber 16 for discharge through a suitable conduit, not illustrated. The chips continue upward, partly in response to the centrifugal force already acquired and partly in response to air drawn through the machine, past the screen 14 to the upper portion 18 of the rotor and are thence flung centrifugally into the annular chamber 19. The chips are then thrown out of the annular chamber through a tangential exit 21 and are conducted to any desired receiving means. This movement of the chips will be strongly assisted by the air flow through the separator in response to the rotation of the rotor 9 but may be increased substantially if desired, and as is preferable, by the use of impellers 22 arranged around the perimeter of the upper portion 18.

All of the foregoing is the known construction set forth in detail in U.S. Pat. No. 4,137,176 and is referred to herein only for convenience in reference and to promote a full understanding of the present invention.

Figure 3:
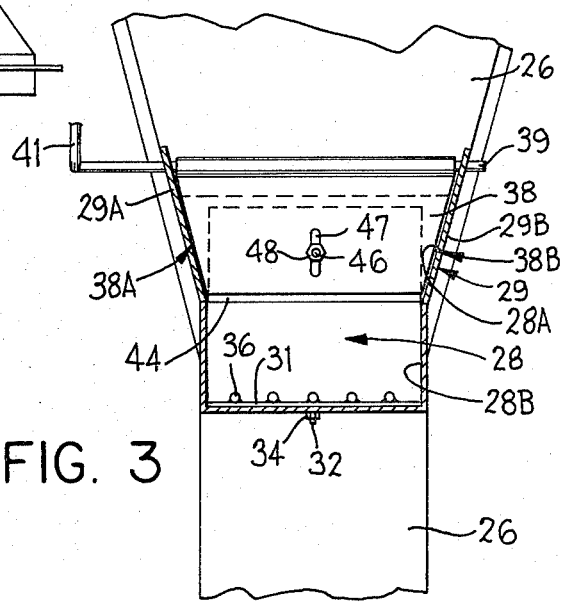
FIG. 3 is a sectional view taken along the line III—III of FIG. 1.
Figure 2:
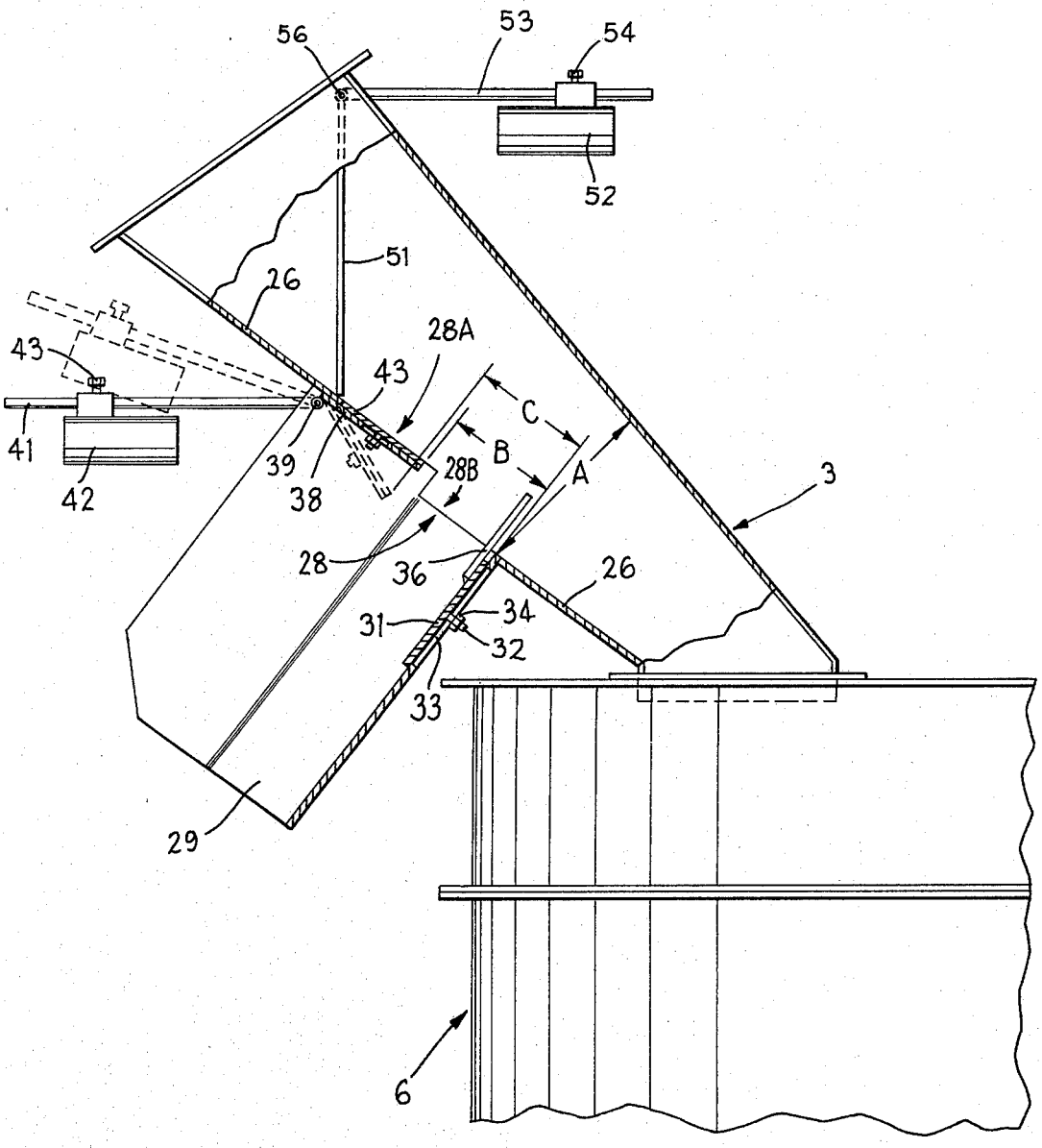
FIG. 2 is a side elevational, partially broken view illustrating a portion of the separator and details of the feeding device.

Turning now to the structure of the present invention, the tubular chute 3 may be horizontally disposed with a conveyor apparatus therein to effect a movement of the material therein or, as illustrated, inclined at an angle of approximately 45° to the horizontal such that the force of gravity acts to effect the movement of the material therein. The chute 3 is provided with a bottom wall 26 having an opening 28 therethrough (FIG. 2). The portion of the chute 3 upstream of the opening 28 (FIGS. 3 and 4) converges in cross-sectional size toward the opening 28, and the portion of the chute 3 downstream of the opening 28 converges more gradually in cross-sectional size toward the opening 4 into the separator 6. The opening 28 has an equilateral trapezoidal shaped portion 28A adjacent the upstream end thereof and a rectangular shaped portion 28B adjacent the downstream end thereof (FIGS. 2 and 3). The portions of the bottom wall 26 upstream and downstream of the opening 28 are both substantially planar and are substantially parallel to each other (FIG. 2), the plane containing the portion of the bottom wall 26 downstream of the opening 28 being spaced vertically a small distance below the plane containing the portion of the bottom wall 26 upstream of the opening 28.

Figure 4:
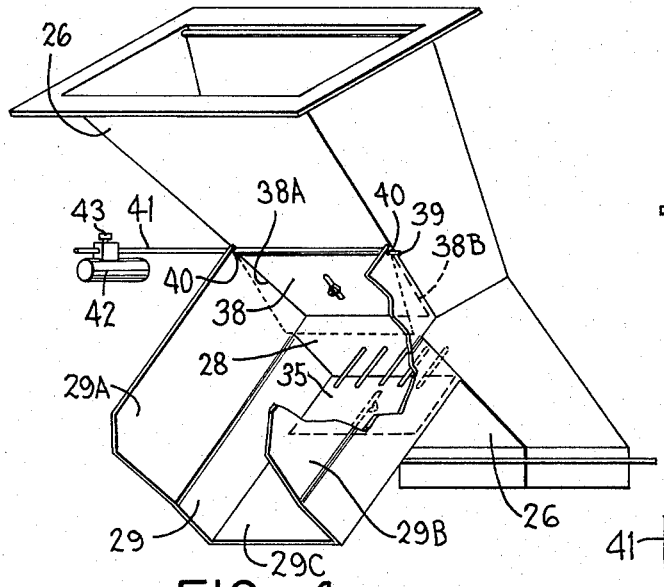
FIG. 4 is a perspective view of the underside of the feeding device.

As best shown in FIG. 4, the opening 28 in the bottom wall 26 communicates with a substantially U-shaped, upwardly opening trough 29 attached to the outside of the chute 3. The trough has upstanding sidewalls 29A and 29B and a bottom wall or floor 29C. The upstanding sidewalls 29A and 29B are flared laterally outwardly adjacent their upper edges at the same angle that the chute 26 converges toward the upstream part 28A of the opening 28. An upstanding barrier plate 31 which has the same width as the chute 3 is slidably mounted to the floor 29C of the trough 29 and extends upwardly through the opening 28 into the chute 3. The barrier plate 31 has a screw stud 32 secured thereto and extending through a slot 33 in the floor 29C of the trough 29 (FIG. 2) and may be secured in a desired position by tightening a nut 34 threadedly received on the screw stud 32 on the opposite side of the floor 29C from the barrier plate 31. A plurality of upstanding tines 36 are provided on the upper end of the barrier plate 31 and extend through the opening 28 into the chute 3.

A portion of the bottom wall 26 adjacent the upstream edge of the opening 28 is constructed as an equilateral trapezoidal shaped gate 38 which is fixedly secured to and pivotally supported by a pivot axle 39 extending transversely of the chute 3 just beneath the bottom wall 26 and received through an opening 40 provided in each sidewall 29A and 29B of the trough 29 (FIG. 4). The gate 38 is pivotal between a normal position in which the gate 38 is substantially planar with the rest of the bottom wall 26 upstream of the opening 28, as illustrated by the solid lines in FIG. 2, and a position deflected downwardly from the normal position, as shown by broken lines in FIGS. 2 and 4. It will be noted from FIG. 4 that the lateral edges 38A and 38B of the gate 38 are parallel to the plane of the sidewalls 29A and 29B and are arranged to be at a normal clearance from the sidewalls 29A and 29B when the gate is in the normal position. Since the upper parts of each of the sidewalls is flared outwardly, the clearance space increases as the gate moves toward the open position. A counterbalance arm 41 is secured to and extends radially away from the pivot axle 39 in a substantially horizontal direction and has a position adjustable counterweight 42 thereon, whereby the force of gravity acts on the arm 41 through the counterweight 42 to pivotally urge the gate 38 into its normal position. The counterweight 42 is, as aforesaid, positionally adjustable on the counterbalance arm 41 in order to vary the magnitude of force urging the gate 38 into the normal position, and is secured in the desired position along the counterbalance arm 41 by a lock knob 43 and set screw arrangement.

As shown in FIG. 3, an adjusting plate 44 is slidably mounted on the top of the gate 38, and is utilized to vary the preset size of the downstream part 28B of the opening 28. Movement of the adjusting plate 44 is guided by a screw stud 46 secured thereto and extending downwardly through a longitudinal slot 47 in the gate 38, and the adjusting plate 44 may be secured in a desired position by tightening a lock nut 48 threadedly received on the screw stud 46 on the opposite side of the gate 38 from the plate 44. This construction presents a smooth surface on the top of the gate so that metal shavings and the like will not snag thereon and the nut will be readily accessible for adjustment purposes.

A vane 51 is fixedly secured to and pivotally supported by a pivot axle 56 on the inside of the chute 3 upstream from the opening 28, as best illustrated in FIG. 2. A counterweight 52 is adjustably mounted on an externally accessible arm 53 of the pivot axle 56 and the position of the counterweight on the arm can be adjusted by convenient means, such as the lock knob 54 and set screw arrangement for movement toward and away from the pivot axle 56 in order to control the effective weight of the vane 51.

OPERATION

Although the operation of the apparatus will be obvious to one skilled in the art from the foregoing description, a brief description of the operation is provided hereinafter to ensure a complete understanding of the invention.

The operation of the basic apparatus consisting of the hopper 1, conveyor 2, chute 3, separator 6 has been set forth briefly above and is set forth fully in the aforesaid U.S. Pat. No. 4,137,176. Hence, no further review of the operation of this portion of the apparatus is necessary except to emphasize that the operation of the rotor 9, particularly where impellers 22 are used, creates a strong inflow of air into the separator through the opening 4 and out through the opening 21.

It will be recognized that the pivotal vane 51 (FIG. 2) limits the amount of air entering the chute 3 at the upper end thereof, and therefore the inflow of air generated by the operation of the separator through the opening 4 will induce a very strong flow of air into the chute 3 through the opening 28. The flow of air through the opening 28 must be sufficient to entrain the smaller chips or at least those pieces having a high resistance to air flow and to entrain liquid present in the chute 3 and to carry the chips and liquid over the barrier plate 31 and through the opening 4 into the separator 6, but will be insufficient to entrain large pieces of metal, or at least those pieces having a low resistance to air flow, in the mixture in the chute 3, which pieces of metal will drop through the opening 28 and be carried by the U-shaped trough 29 to a not illustrated receptacle.

It is essential to the invention that there be a pressure drop across the opening 28 from the outside of the chute 3 to the inside thereof, and more particularly, a negative pressure on the inside of the chute 3, as this will ensure that sufficient air will be pulled through the opening 28 to effect a meaningful classification of material.

With the foregoing in mind, the adjustment of the preset size of the opening 28 will now be described. It is, of course, obviously desirable that the opening 28 be large enough to permit the largest pieces of metal expected to come through the system to fall easily therethrough, even though same are in positions other than positions exactly aligned with said opening, and at the same time it is desirable that the opening 28 be no larger than necessary, in order to minimize any tendency for the chips to fall therethrough. In other words, having in mind the total amount of air to be drawn into the separator 6 through the chute 3, the opening 28 should be adjusted to a size permitting the large or low resistance to air flow pieces of metal which are to be separated from the total mixture to fall easily therethrough and ensuring that the airflow therethrough into the chute 3 will be strong enough to keep chips and liquid from falling through the opening but not so strong as to inhibit the falling therethrough of the aforesaid large or low resistance to air flow pieces of metal. Thus, the requisite positioning of the adjustable plate 44 (FIG. 3) will vary according to the size, shape and weight of the chips and further according to the size, shape and weight of the larger pieces of metal to be separated therefrom. Once the proper position for the adjusting plate 44 has been determined, the plate 44 can be secured against further movement by tightening the nut 48.

Similarly, it is desirable that the barrier plate 31 (FIG. 2) be as low as possible in order to facilitate the passage of chips through the chute 3 with a minimum of turbulence and a minimum loss of chips through the opening 28, but such positioning of the barrier plate 31 must be high enough to ensure that the larger pieces of metal to be separated from the mixture will be sure to strike the tines 36 on the barrier plate 31 and drop through the opening 28. The tines 36 (FIG. 4) mounted on the barrier plate 31 are spaced from each other by distances appropriate to ensure that large pieces of metal will be likely to strike one or more tines and drop through the opening 28, but that the smaller chips and the liquid will pass between the tines. After the barrier plate 31 has been preset to the correct position for proper system operation, it is fixed against subsequent movement by tightening the nut 34 on the screw stud 32.

With the above adjustments properly made, a mixture of material comprising chips, larger pieces of metal and a liquid, such as cutting oil, will be placed in the hopper 1 (FIG. 1) and then the conveyor 2 and rotor 9 will be started. The conveyor 2 will convey the mixture to the chute 3. The pivotal vane 51 at the upper end of the chute 3 will function to cause the mixture to be evenly distributed rather than bunched as it is introduced into the chute, and will also prevent large pieces of metal from bouncing over the barrier plate 31 and passing into the separator 6.

Meanwhile, operation of the rotor 9 will draw a strong stream of air into the chute 3 through the opening 28. As the mixture in the chute 3 approaches the opening 28, air entering the chute 3 through the opening 28 will pick up and carry any chips having a high resistance to air flow not already entrained in an air stream over the barrier plate 31 and ultimately into the separator 6 for separating in the usual manner. Heavier pieces of metal or those pieces having a low resistance to air flow contained within the mixture will be unable to clear the top of the tines on the barrier plate 31 or pass therebetween, despite the strong air flow into the chute 3 through the opening 28, and will drop through the opening 28 into the trough 29 for appropriate disposition.

In the event that a piece of metal introduced into the chute 3 is so large that it will not fit through the opening 28 with the gate 38 in the normal position, the weight of the piece of metal will cause the gate 38 to be deflected downwardly from its normal position against the forces generated by the counter-weight 42 acting through the arm 41, as illustrated in FIG. 2, thereby increasing the size of the opening 28 a sufficient amount to allow the piece of metal to drop through the opening 28. After the piece of metal has passed through the opening 28, the counterweight 42 acting through the arm 41 will return the gate 38 to its normal position. Normally, the counter-weight 42 will be adjusted to a position on the arm 41 which will ensure that the gate 38 can be deflected from its normal position by the weight of a large piece of metal, but that at other times the gate 38 will be maintained in its normal position.

It will be recognized that the increase in the dimensions of the hole 28 resulting from a deflection of the gate 38 from its normal position, illustrated by the reference letters B and C in FIG. 2, will necessarily result in a slight decrease in the velocity of the air entering the chute 3 through the opening 28, due to the fact that the volume of air entering the opening 28 remains constant, thereby facilitating the passage of the large piece of metal through the opening 28. Since the dimensions of the lower portion of the chute 3, designated by reference letter A in FIG. 2, remain unchanged, the velocity of the air flow through the lower portion of the chute 3 will not be affected by the reduction in velocity of the air flow through the opening 28, and chips and liquid entrained in the air flow through the lower portion of the chute 3 will be carried into the separator 6 for classification in the usual manner.

It will also be recognized that a temporary downward deflection of the gate 38 in effect causes a temporary downward shift of the portion of the bottom wall 26 of the chute 3 at the upstream edge of the opening 28, such that the barrier plate 31 appears relatively higher to material passing through the chute 3 (FIG. 2).

As stated above, the chute 3 is positioned at approximately a 45° angle to the horizontal. It will be evident from the foregoing description of operation that this preferred angle permits the mass of material in the chute 3 to slide downwardly by gravity while simultaneously permitting the large pieces of metal to fall by gravity through the opening 28. It is conceivable, however, that where greater or lesser angles are desirable for other reasons, vibration of the chute 3 can be utilized to assist the movement of the material down the chute 3 or to assist the movement of the large pieces of metal through the opening 28 and down the trough 29.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is clamed are defined as follows:

1. In a system for recovering the cutting tool liquid from a mixture of heavy, high mass density components, machine turnings, cutting chips and cutting tool liquids, said system including a negative air pressure generating centrifugal separator means for extracting liquids from the machine turnings and cutting chips, means for separating the heavy components prior to entry of the mixture into said centrifugal separator means, said means comprising: a feed conduit communicating with an inlet opening in said centrifugal separator means and being the only inlet opening communicating with the interior thereof, said conduit having a bottom wall, means limiting the quantity of air entering said feed conduit at its intake end whereby said centrifugal separator means maintains a negative air pressure throughout said conduit; an opening in said bottom wall of said conduit providing an intake of air at a higher pressure than that in said conduit creating an entering column of air at a velocity sufficient to entrain said machine turnings, cutting chips and the cutting tool liquids while permitting said heavy components to drop through said opening, said means limiting the quantity of air entering said feed conduit also effecting a major portion of said air to enter said conduit through said opening; and movable gate means automatically responsive to the weight of a heavy, larger than normal size component for effecting an automatic, temporary increase in the size of said opening thereby facilitating said heavy, larger than normal size component to drop through the opening and a return of said opening to the initial size thereof.

2. The air classification system defined in claim 1, wherein said gate means comprises a gate member blocking the inflow of air into said opening, said gate means including support means supporting said gate member for movement between a normal position defining said opening of preset size and a downwardly deflected position defining said opening of temporarily increased size.

3. The air classification system defined in claim 2, wherein said movable gate member is coplanar with the plane of said bottom wall immediately upstream of said opening of preset size when in said normal position.

4. The air classification system defined in claim 3, wherein said support means supports said movable member for pivotal movement about a pivot axis extending transversely of conduit along said bottom wall at a point spaced upstream from said opening of preset size, and wherein control means are provided for continuously urging said gate member into said normal position.

5. The air classification system defined in claim 4, wherein said control means comprises an arm affixed to said gate member and a counterweight adjustably mounted on said arm, said counterweight being positionally adjustable on said arm relative to said pivot axis for varying the magnitude of the forces urging said gate member toward said normal position.

6. The air classificaton system defined in claim 4, including a plate member slidably mounted on said gate member for adjusting said preset size of said opening.

7. The air classification system defined in claim 2, including an upstanding barrier means in said conduit at the downstream end of said opening for facilitating more of an exposure of said barrier to said mixture moving through said conduit when said gate member is in said deflected position than when in said normal position.

8. The air classification system defined in claim 7, including adjustment means for adjusting the extent to which said barrier means projects into said conduit.

9. The air classification system defined in claim 7, including a plurality of spaced upstanding tines mounted along the upper edge of said barrier means.

10. The method of air classifying of heavy, high mass density components from a mixture of such components, machine turnings, cutting chips and cutting tool liquids, including the steps of moving said mixture along a path through an enclosed conduit having an opening in the bottom surface thereof intermediate its ends, withdrawing air at a discharge end of said conduit, substantially blocking the entrance of air into said conduit at an inlet end so that a major portion of inflowing air will occur through said opening to maintain a negative air pressure in said conduit, said major portion of air being drawn into said conduit through said opening at a velocity and volume sufficient to entrain said machine turnings, cutting chips and cutting tool liquids and carry said entrained components through said conduit to said discharge end thereof, but insufficient to prevent said heavy, high mass density components from dropping through said opening under the pull of gravity, and automatically, temporarily increasing the size of said opening in response to the presence in said conduit of a said heavy, high mass density component which is too large to negotiate the preset opening in order to permit said heavy, high mass density component to pass through said opening and a return of said opening to the initial size thereof.

* * * * *